US008864126B2

(12) United States Patent
Snider et al.

(10) Patent No.: US 8,864,126 B2
(45) Date of Patent: Oct. 21, 2014

(54) DOCUMENT STORAGE ASSEMBLY

(75) Inventors: John D. Snider, West Chester, PA (US); Karen Marvin, Pottstown, PA (US); Chris Carmine, Thornton, PA (US); Kenneth B. Wood, Romansville, PA (US); Alfred F. Bergeron, Chester Springs, PA (US); Robert Clauser, Columbus, NJ (US)

(73) Assignee: MEI, Inc., Malvern, PA (US)

( * ) Notice: Subject to any disclaimer, the term of this patent is extended or adjusted under 35 U.S.C. 154(b) by 0 days.

(21) Appl. No.: 13/497,615

(22) PCT Filed: Sep. 21, 2010

(86) PCT No.: PCT/US2010/049618

§ 371 (c)(1),
(2), (4) Date: Jul. 18, 2012

(87) PCT Pub. No.: WO2011/037904

PCT Pub. Date: Mar. 31, 2011

(65) Prior Publication Data

US 2012/0273378 A1 Nov. 1, 2012

Related U.S. Application Data

(60) Provisional application No. 61/244,611, filed on Sep. 22, 2009.

(51) Int. Cl.
*B65H 1/02* (2006.01)
*G07D 11/00* (2006.01)

(52) U.S. Cl.
CPC ..... *G07D 11/0012* (2013.01); *G07D 11/0006* (2013.01)
USPC ..... 271/149; 271/155; 271/159; 271/160

(58) Field of Classification Search
USPC ..... 271/149, 155, 156, 160
See application file for complete search history.

(56) References Cited

U.S. PATENT DOCUMENTS

| | | | | |
|---|---|---|---|---|
| 4,978,416 | A * | 12/1990 | Potter et al. | 156/571 |
| 6,896,255 | B1 * | 5/2005 | Fick et al. | 271/126 |
| 7,481,308 | B2 * | 1/2009 | Bergeron et al. | 194/350 |
| 7,789,214 | B2 * | 9/2010 | Bergeron et al. | 194/350 |
| 8,146,914 | B2 * | 4/2012 | Cost | 271/217 |

FOREIGN PATENT DOCUMENTS

| | | | |
|---|---|---|---|
| JP | S5081897 | U | 7/1975 |
| JP | 2004310773 | A | 11/2004 |

* cited by examiner

*Primary Examiner* — Kaitlin Joerger
(74) *Attorney, Agent, or Firm* — Mintz Levin Cohn Ferris Glovsky and Popeo, P.C.

(57) ABSTRACT

A document storage assembly for storing documents such as banknotes in a stacked configuration includes a support plate assembly for biasing the stack of documents toward an opening in the housing of the document storage assembly. The housing can include an assist mechanism to facilitate displacement of the stack of documents during the stacking of a newly received document.

16 Claims, 16 Drawing Sheets

DOCUMENT STORAGE ASSEMBLY

This application is a national phase filing under 35 U.S.C. §371 of international patent application number PCT/US2010/049618 filed Sep. 21, 2010, which claims priority U.S. provisional patent application No. 61/244,611 filed Sep. 22, 2009, each of which is hereby incorporated by reference in its entirety.

FIELD OF DISCLOSURE

This disclosure relates to a storage assembly for documents and, more particularly, to a stack management arrangement for storing documents in a stack. For the purposes of the disclosure, the term document includes, but is not limited, to a banknote, sheet, bill, coupon, security paper, currency, ticket, or any other flexible planar item of a similar nature.

BACKGROUND

Document storage assemblies forming a compartment (e.g., a currency cassette) and usable with an automated transaction machine often include a platform, such as a pressure plate, to support a stack of bills. The pressure plate, along with any previously stacked bills, can be moved to permit stacking newly received bills. As the number of bills in the stack increases, any slight variation between the plane of the pressure plate and the plane of the stacked bills during movement due to stacking may cause the stack to buckle or drop under the force of gravity. If the stack buckles, the document storage cassette may be unable to accept any more bills for storage and thus the automatic transaction machine may require servicing. It is therefore important to minimize the variation between the plane of the pressure plate with respect to the plane of the stacked bills while stacking newly received bills. It is also important to maximize the space within the document storage cassette that is available for storing currency.

Pressure plate assemblies typically use one or more springs (e.g., conical springs) to bias the pressure plate in a certain direction. In a conventional assembly, the pressure plate uses a pin on each longitudinal edge, which fits into a slot of the storage compartment of the document storage assembly, to guide the pressure plate along a slot while newly received bills are stacked. Other pressure plate assemblies use a cantilever plate that is connected to a sleeve bearing that moves along a post to guide the pressure plate in order to stack newly received bills. Alternatively, a scissor mechanism coupled beneath the pressure plate may be used to move the pressure plate while stacking newly received bills. Yet a further alternative is to configure the pressure plate assembly so as to form a rack and meshed gear arrangement as disclosed in U.S. Patent Publication No. 2004/0195758, which is herein incorporated by reference in its entirety.

In certain arrangements, the document storage assembly is coupled to a bill validator and configured to stack bills within the assembly in a vertical orientation. More specifically, the bills are stacked so that the plane of the stacked bills is oriented in the vertical sense. When such a configuration is required, a condition can arise in which additional force is needed to displace the stack of bills within the document storage assembly. As the stack of bills stored within the document storage assembly increases, the stack begins to fall downward due to the effect of gravity and the stack begins to buckle. As the stack buckles, the frictional force caused by dragging the stack along the interior walls of the document storage assembly greatly increases the force needed to displace the stack of bills during a stacking event of a newly received bill.

SUMMARY

This disclosure relates to a document storage assembly for storing documents in a stacked configuration. In some implementations there is provided a support plate assembly for biasing a stack of documents toward an opening in the housing of a document storage assembly. In some implementations the housing of the document storage assembly includes an assist mechanism to allow the stack of notes to be displaced during the stacking of a newly received document.

In some implementations, the document storage assembly is removably coupled to a document validation system. As is known, document validation systems are used to receive a document and determine the denomination and/or the authenticity of the inserted document. The general operation of document validation devices is known and, therefore, is not described in detail in the current disclosure.

The document storage assembly can include a stacking mechanism for inserting newly received documents into the document storage assembly storage compartment at least partially defined by the housing; Alternatively, the stacking mechanism can be a component of the document validation device. The document storage assembly includes a housing defining a storage compartment for containing the stacked documents. The housing includes an opening at one end through which newly received documents enter the housing, and the documents are stacked within the storage assembly. In some implementations, the housing further includes a movable access cover coupled to the housing body for allowing access to the contents stored therein. The removable access cover can be configured to have a securing feature (e.g., a locking mechanism) associated therewith to selectively secure the access cover between a closed (or locked) condition and an open or removed condition. For example, the access cover can include a locking mechanism for locking the access cover in place. In some implementations the access cover is pivotally coupled to the housing and in other implementations the access cover is slidingly engagable with the housing.

The document storage assembly includes a support plate for supporting a stack of documents. The support plate can be removably coupled to the housing and movable relative to the housing to allow for a displacement of a stack of documents during the stacking of a newly received document. In some implementations, the housing includes parallel racks, and the support plate includes gears for operative engagement with the parallel racks. In some implementations, gears are rotatably connected to at least two substantial edges of the support plate, and one or more substantially parallel racks are configured to engage one or more of the gears. In some implementations, the gears can be connected to one or more shafts at a first edge of the support plate, and one or more of the shafts can extend to a second edge of the support plate. One or more of the gears can be coupled to one or more of the shafts at the second edge of the support plate.

In some implementations, the support plate includes a biasing mechanism for biasing the support plate towards the opening of the housing (e.g., towards the direction where documents enter the storage compartment). The biasing mechanism can include a spring (e.g., a torsion spring) coupled to at least one of the shafts to cause rotation of the associated shaft in a direction resulting in the support plate being urged toward the opening (or entry opening) of the housing.

The support plate can further include an installation mechanism operatively coupled to the biasing mechanism. The installation mechanism can be configured so as to prevent the biasing mechanism from urging the support plate toward the opening in the housing. In some implementations, the installation mechanism includes a movable actuator (or toggle) so as to engage at least one of the gears (or associated components) associated with the shaft coupled to the biasing spring to prevent rotation thereof. In some implementations, the support mechanism includes at least two pairs of gears connected to at least two shafts, respectively. In some implementations, the biasing spring is operatively coupled to one of the at least two shafts. In some implementations the installation mechanism is configured to prevent rotation of at least one shaft and allow rotation of the at least one other shaft.

In some implementations, the document storage assembly includes an assist mechanism for reducing the force required to displace a stack of documents as a newly received document is stacked. The assist mechanism can be selectively operable dependent on the size of the stack of documents exceeding a predetermined threshold. The assist mechanism can include a sliding plate slidingly coupled to the housing so as to support a stack of documents during displacement when a newly received document is stacked. In some implementations, the sliding plate is slidingly coupled to the housing by rolling balls or bearings. The sliding plate can be coupled to the housing other sliding mechanisms, for example sliding rails or groves.

When the document storage assembly is integrated into a document accepting or handling device in a horizontal configuration, the stack of documents will eventually settle onto the lower interior surface of the housing due to the influence of gravity. In prior known configurations, the force required to displace a stack of notes resting on the lower surface of a horizontal cassette requires a large pushing (or displacing) force from the stacking mechanism in order to displace the stack enough to deliver a newly received document. In an exemplary implementation of the document storage assembly, an assist mechanism is incorporated to minimize or reduce the force needed to stack a newly received document so that standard (or low power) stacking mechanisms can be utilized. By locating a sliding plate between the stack of documents and the lower surface of the housing, the documents can be displaced during a stacking event in a sliding manner with low friction. The ability to displace the stack of documents with a low frictional resistance allows for a more efficient and smaller force required to displace the stack.

Various aspects of the invention are set forth in the claims.

DETAILED DESCRIPTION OF THE DRAWINGS

Figure 1:
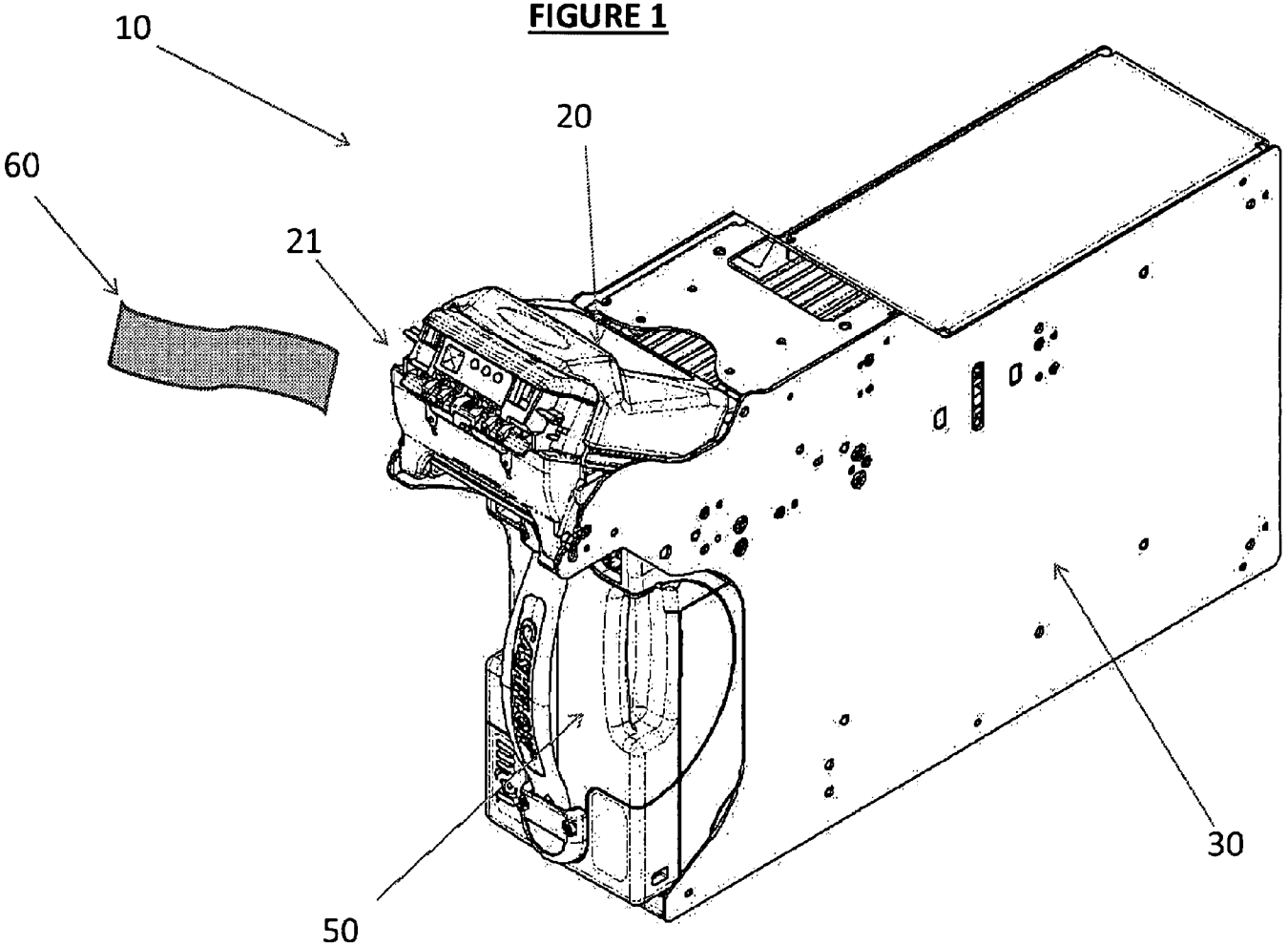
FIG. 1 illustrates a document handling apparatus.

The disclosure relates to a storage assembly for documents and, more particularly, to a stack management arrangement for storing documents in a stack. In some implementations, a document storage assembly 50 is removably coupled to a document handling apparatus (or device) 10 as shown in FIG. 1. The document handling apparatus 10 can include a document validation module 20 and a frame structure 30. In some implementations, document storage assembly 50 and validation module 20 are removably coupled to frame structure 30.

The validation module 20 is configured to accept an inserted document 60 at an inlet 21 and transport document 60 along a transport path past a document sensing component. The document sensing component is arranged to determine at least the denomination of document 60 or the authenticity of document 60. Documents determined to be acceptable by validation module 20 are transported to the document storage assembly 50. In some configurations, document 60 is transported by document handling apparatus 10 to a position adjacent to an opening 52 in document storage assembly 50 (see FIG. 4*b*). In some implementations, document storage assembly 50 is coupled to document handling apparatus 10 so as to store a stack of documents in a stacked configuration with the plane of each stacked document 60 oriented generally vertical or perpendicular to the longitudinal dimension of document storage assembly 50

Figure 2:
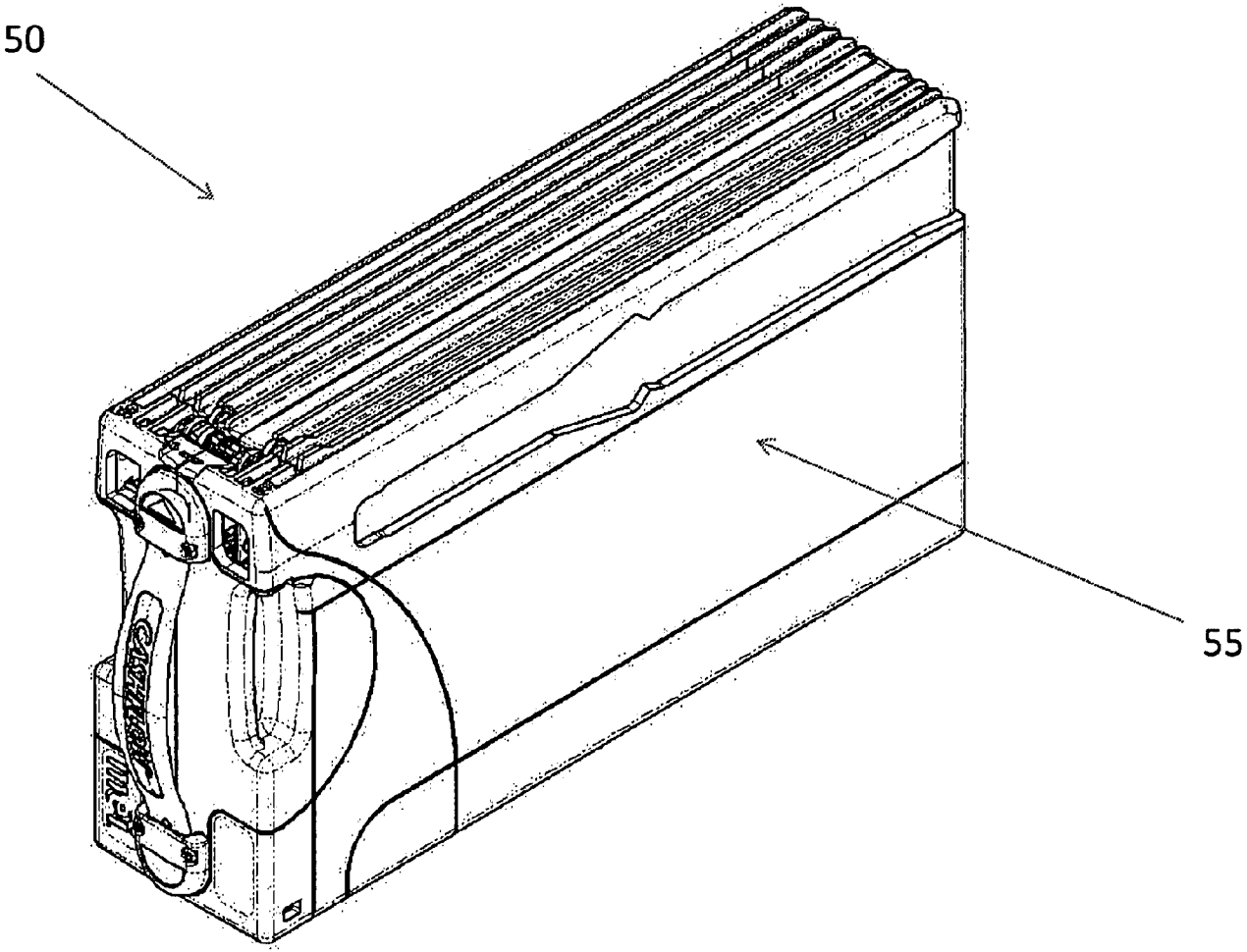
FIG. 2 illustrates a document storage assembly including a housing.
Figure 4A:
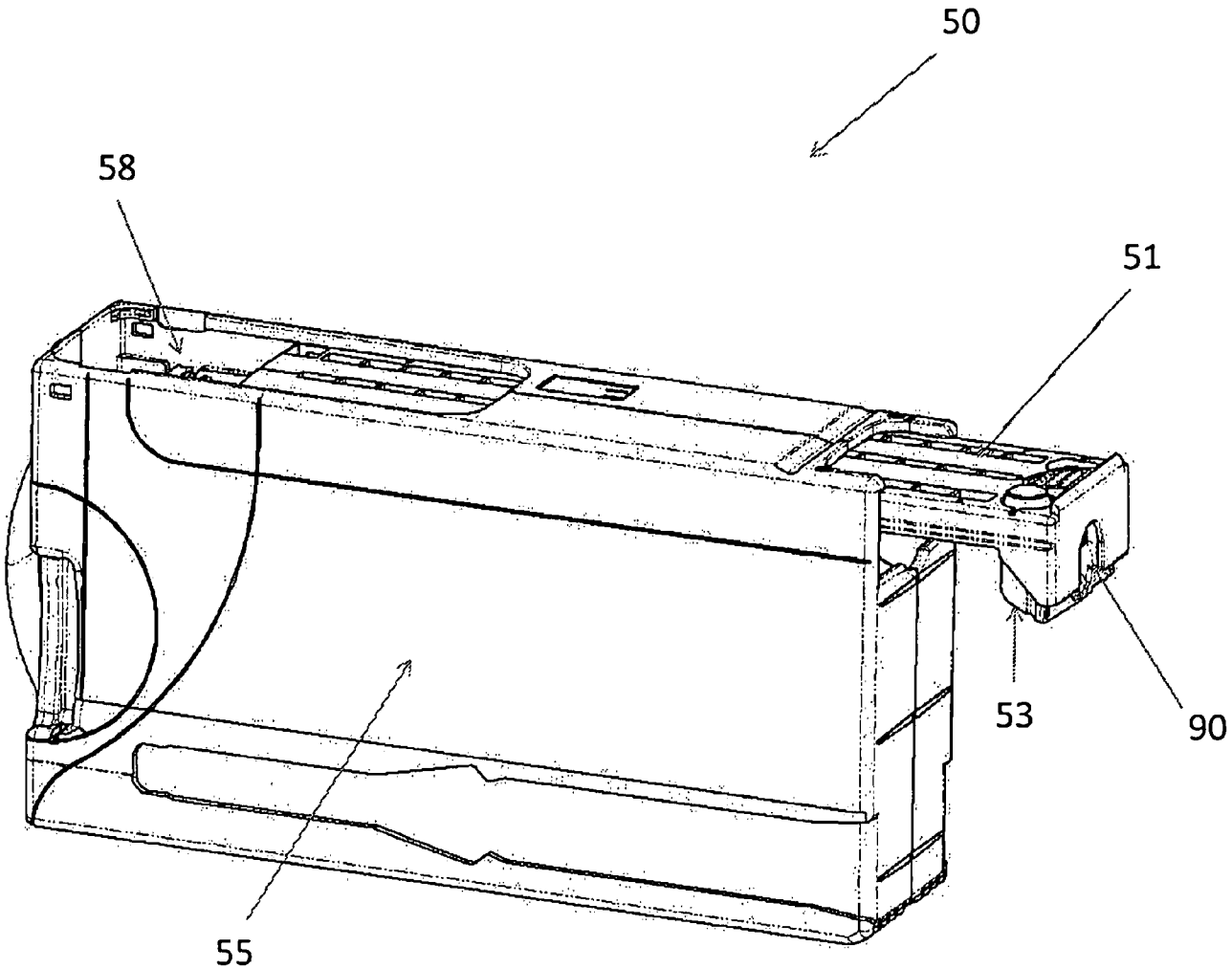
FIG. 4*a* illustrates a document storage assembly including a movable access cover in an open position.
Figure 4B:
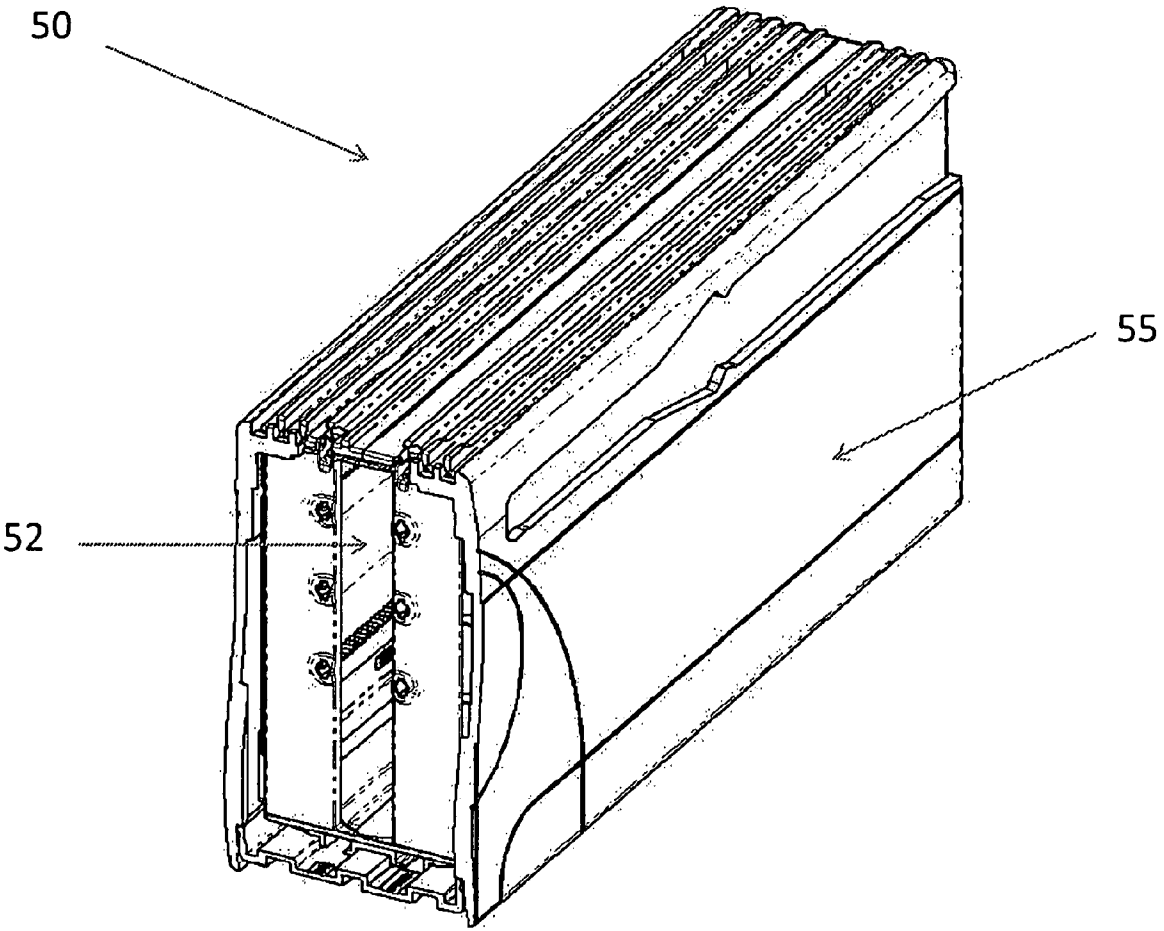
FIG. 4*b* illustrates a documents storage assembly including an opening for receiving documents.
Figure 11:
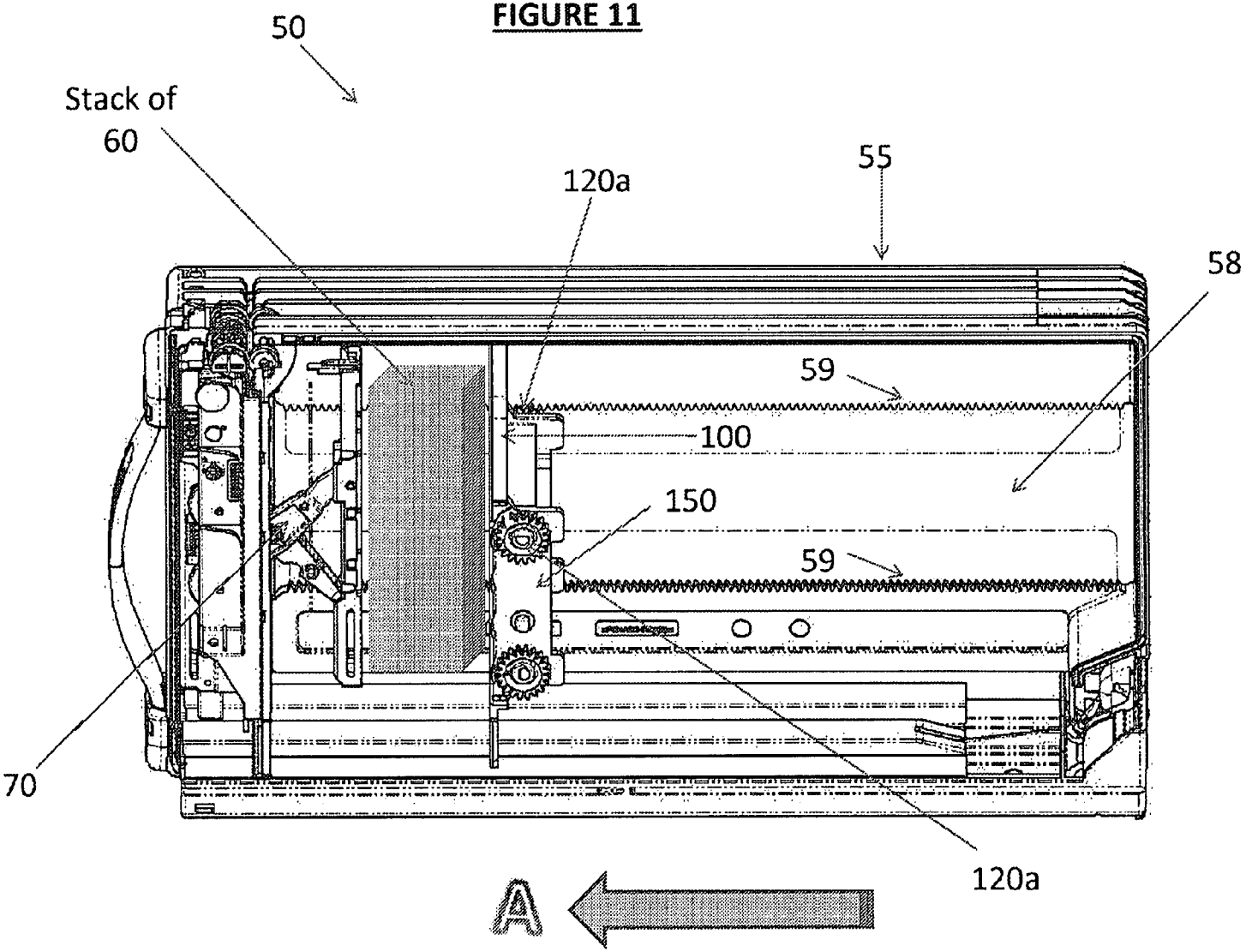
FIG. 11 illustrates a document storage assembly containing a stack of documents suspended above the housing.

Document storage assembly 50 can include a housing 55 defining an internal storage compartment 58 as shown in FIGS. 2 and 4. Housing 50 includes opening 52 through which newly received documents are inserted into and stacked within compartment 58 as shown in FIG. 4*b*. In some implementations, document storage assembly 50 further includes a document stacking mechanism 70 for stacking a newly received document 60 into document storage assembly 50 as shown in FIG. 11. In some configurations, document stacking mechanism 70 is a scissor type or plunger stacking mechanism as commonly known in the art. Other forms of stacking mechanisms 70, known in the art, can be used in conjunction with document storage assembly 50. In other implementations, stacking mechanism 70 is included with document handling apparatus 10 and operatively coupled to document storage assembly 50 for stacking newly received documents 60 therein as shown in FIG. 11.

Figure 3:
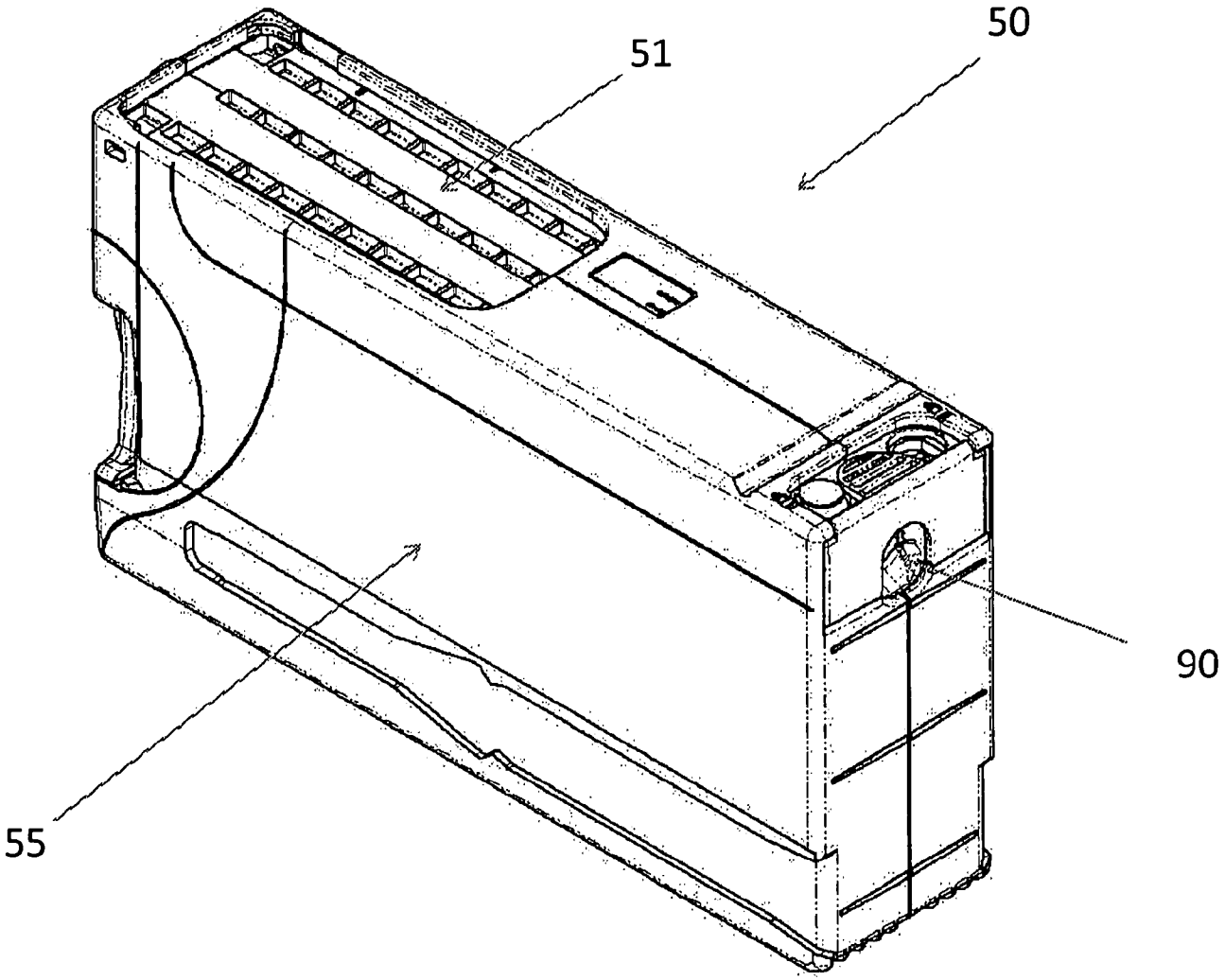
FIG. 3 illustrates a document storage assembly including a movable access cover in a closed position.

In some implementations, housing 55 includes a moveable access cover 51 for selectively providing access to the contents of document storage assembly 50 and movable between an open and closed position as shown in FIGS. 3 and 4. As shown in the illustrated implementation, access cover 51 is slidingly coupled to housing 55. In other implementations, access cover can be pivotally coupled to housing 55. Access cover 51 can further include a locking mechanism 90 for selective engagement with housing 55 to prevent movement of access cover 51 when positioned in a closed configuration.

Figure 5:
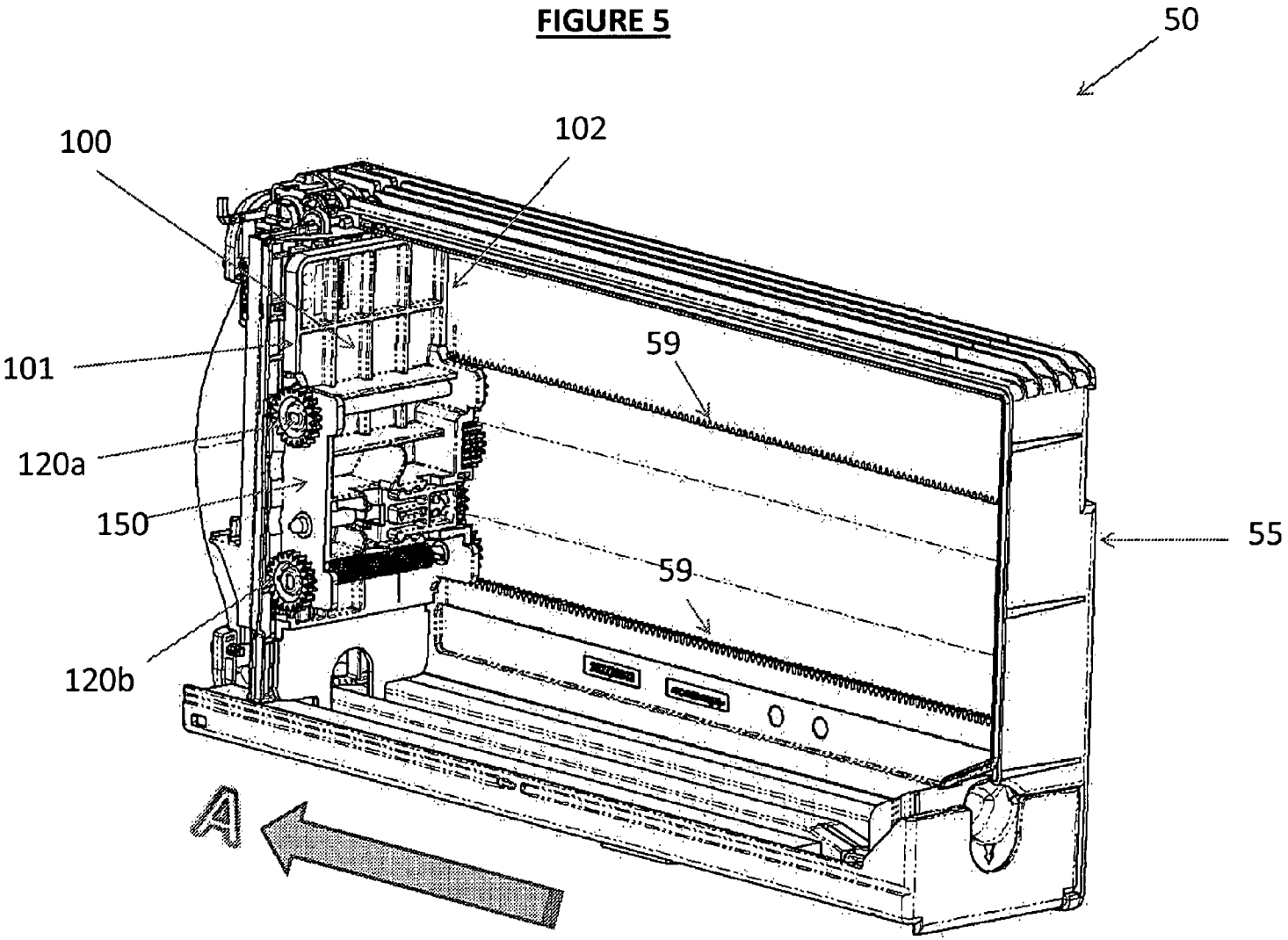
FIG. 5 illustrates a document storage assembly including a support plate coupled to the housing.
Figure 6:
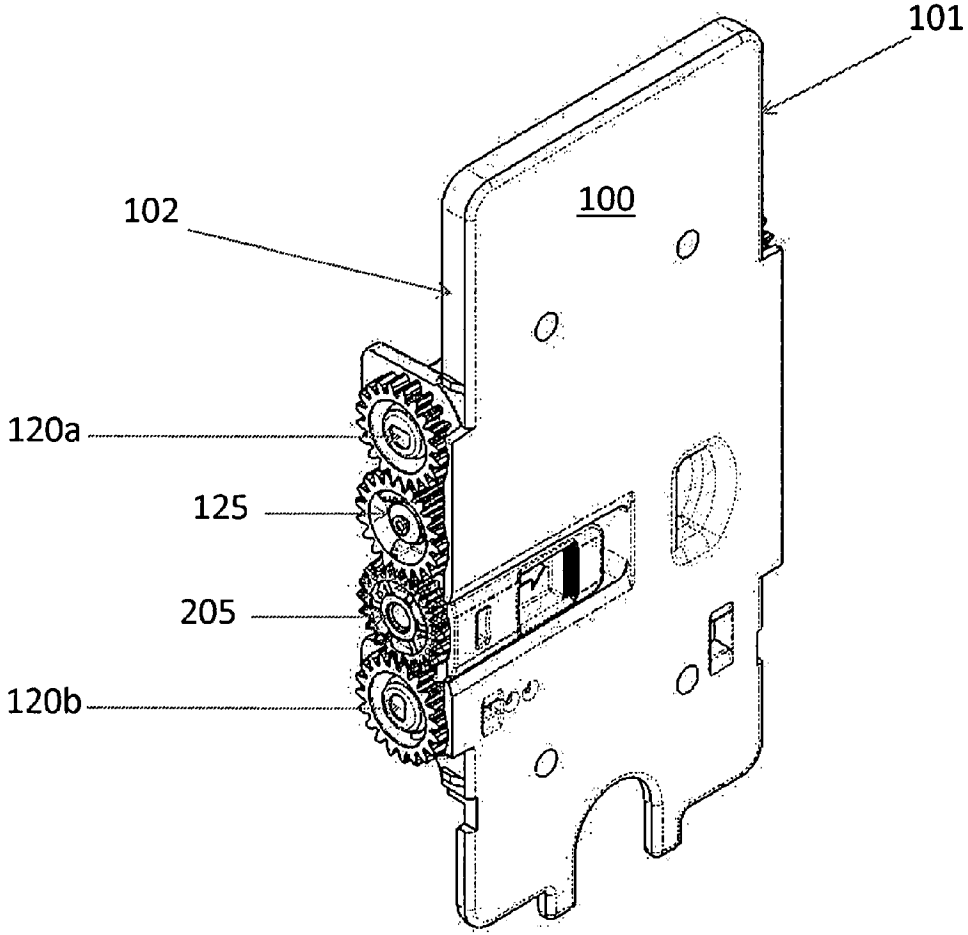
FIG. 6 illustrates a support plate including a plurality of gears.
Figure 7:
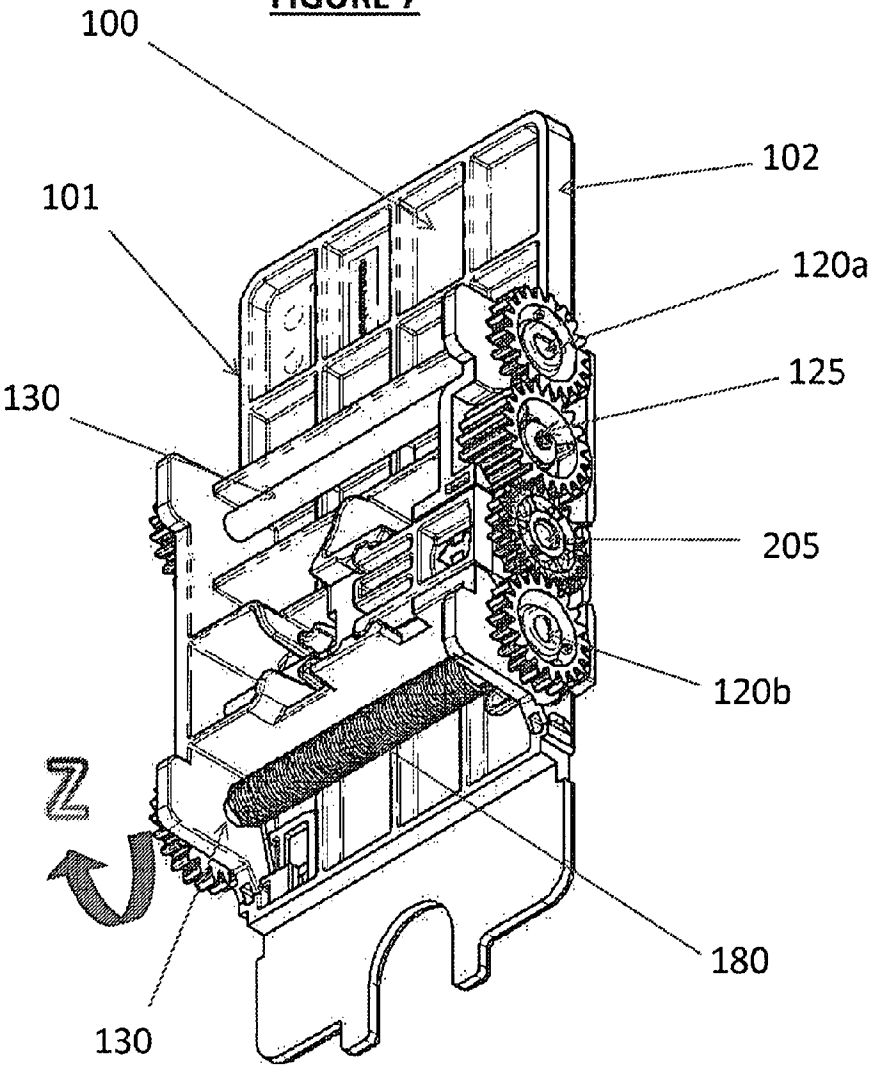
FIG. 7 illustrates a support plate including a biasing mechanism.

Housing 55 can include substantially parallel racks 59 (see FIG. 5). In some implementations, document storage assembly 50 includes a movable support plate 100 for stable support of a stack of documents 60 as shown in FIG. 5. A biasing mechanism 150 is operatively coupled to support plate 100 for biasing support plate 100 toward the direction where newly received documents 60 are inserted onto the stack of documents 60. In some implementations, biasing mechanism 150 includes gears 120*a*, 120*b* rotatably connected at opposite edges 101 and 102, respectively, of support plate 100 as shown in FIGS. 6 and 7. Biasing mechanism 150 further includes at least two shafts 130 arranged to connect at least two pairs of gears 120 on opposite edges of support plate 100. In some implementations, biasing mechanism 150 further includes a spring 180 operatively coupled to one of the shafts 130 (see FIG. 7). Biasing spring 180 is arranged to provide a biasing force to the pair of gears 120 connected by the at least one shaft 130 so as to cause support plate 100 to be urged towards the front of document storage assembly 50 in direction A as shown in FIG. 5. For example, in the configuration shown in FIG. 7, biasing spring 180 is operatively coupled to shaft 130 connected to the lower pair of gears 120 and urges shaft 130 to rotate in direction of arrow Z. Urging of lower shaft 130 in the direction of arrow Z causes lower pair of gears 120 to advance in a direction A along lower rack 59 as shown in FIG. 5.

Figure 8:
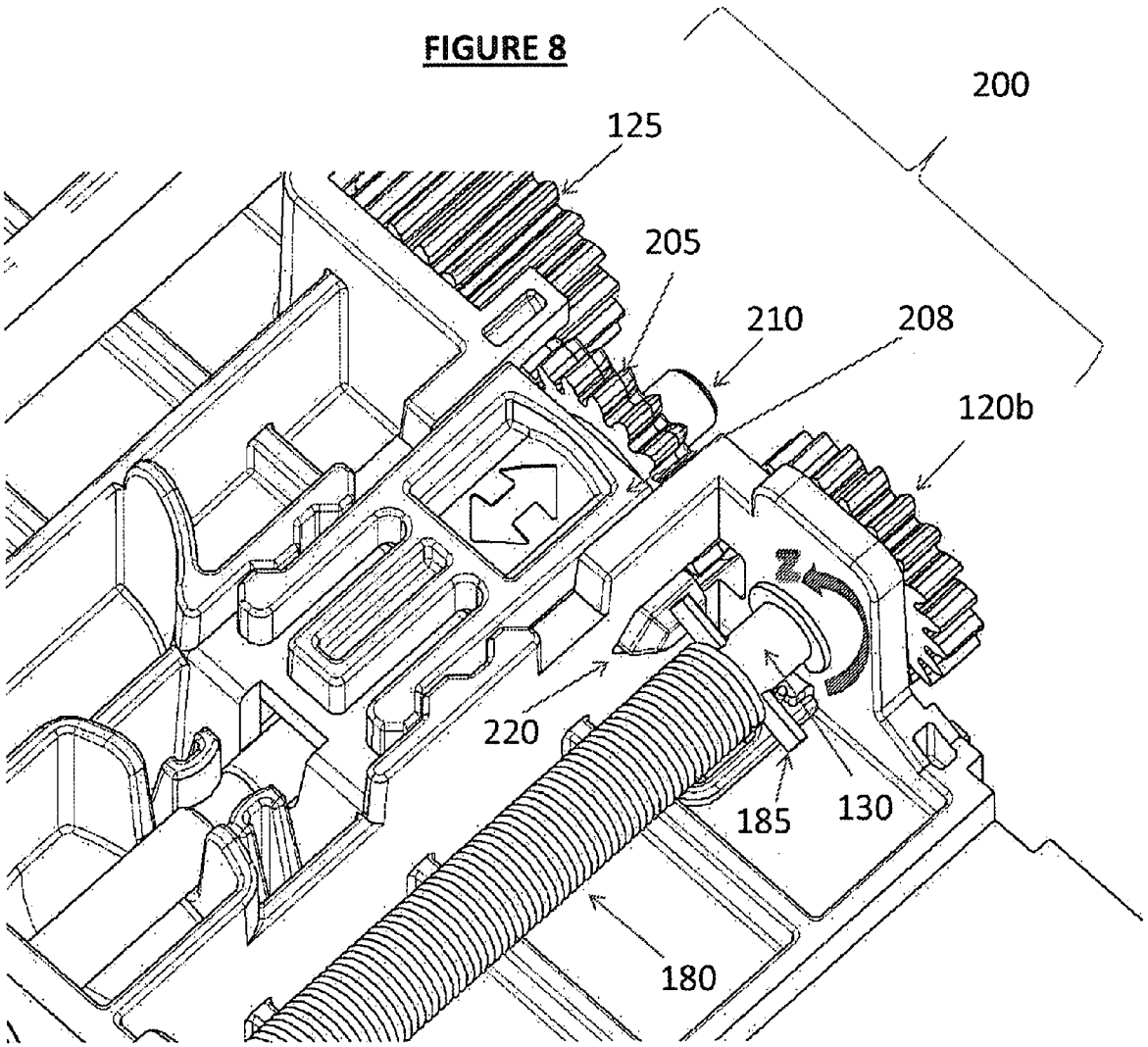
FIG. 8 Illustrates various components of an installation mechanism and a biasing mechanism.

In some implementations, biasing mechanism 150 further includes an installation mechanism 200 for selectively locking biasing mechanism 150. More particularly, installation mechanism 200 is arranged to prevent lower gear pair 120 from advancing forward in direction A when in a locking position. Installation mechanism 200 can include a lock actuator 208, a linking gear 205, locking tab 220, and shaft 210 as shown in FIG. 8. Locking tab 220 can be arranged to engage a locating protrusion 185 of biasing mechanism 150 for preventing further forward rotation (in the direction of arrow Z) of lower shaft 130 of biasing mechanism 150 when installation mechanism 200 is in the locked condition.

Figure 9:
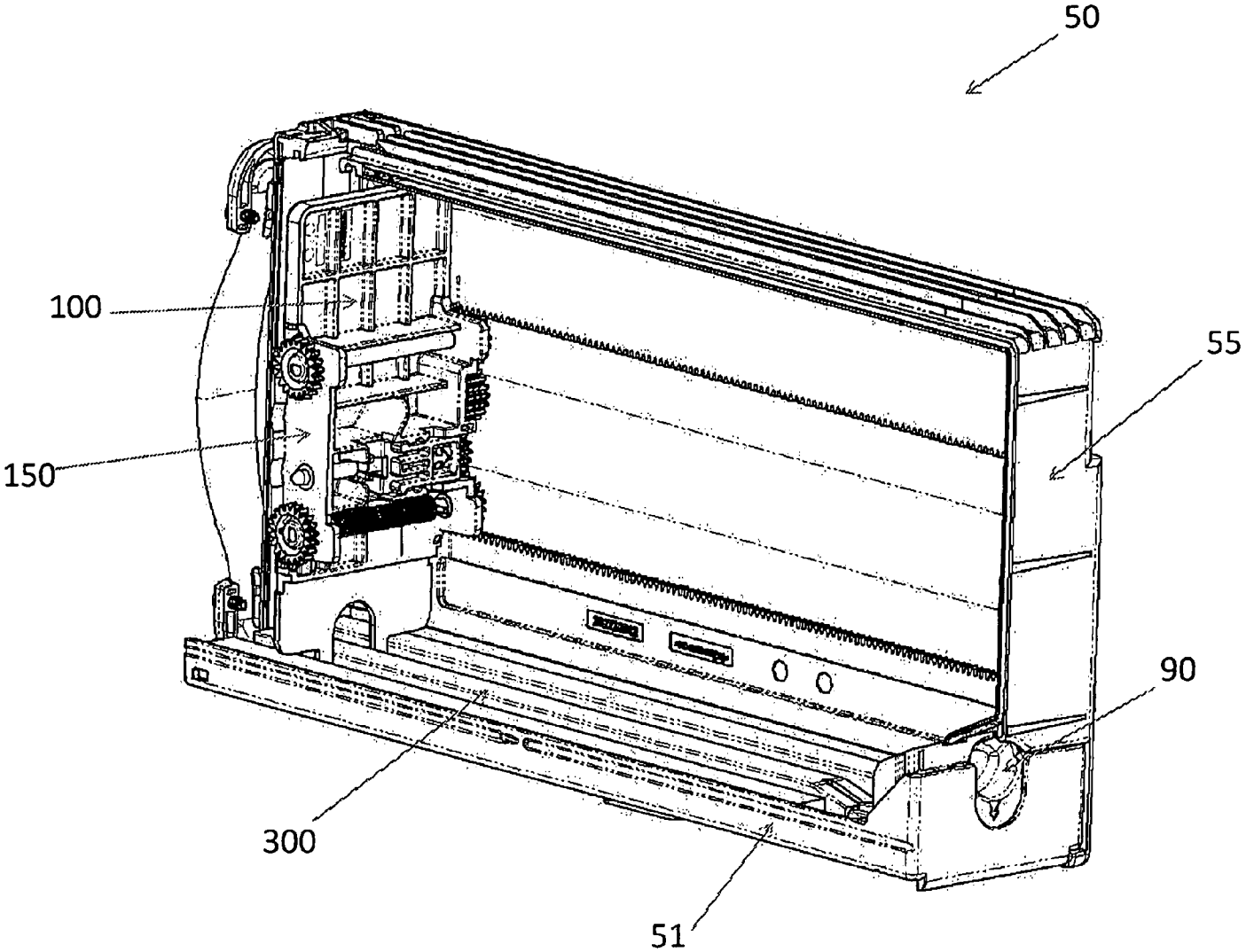
FIG. 9 illustrates a document storage assembly including a movable support plate and a movable assist mechanism.
Figure 10:
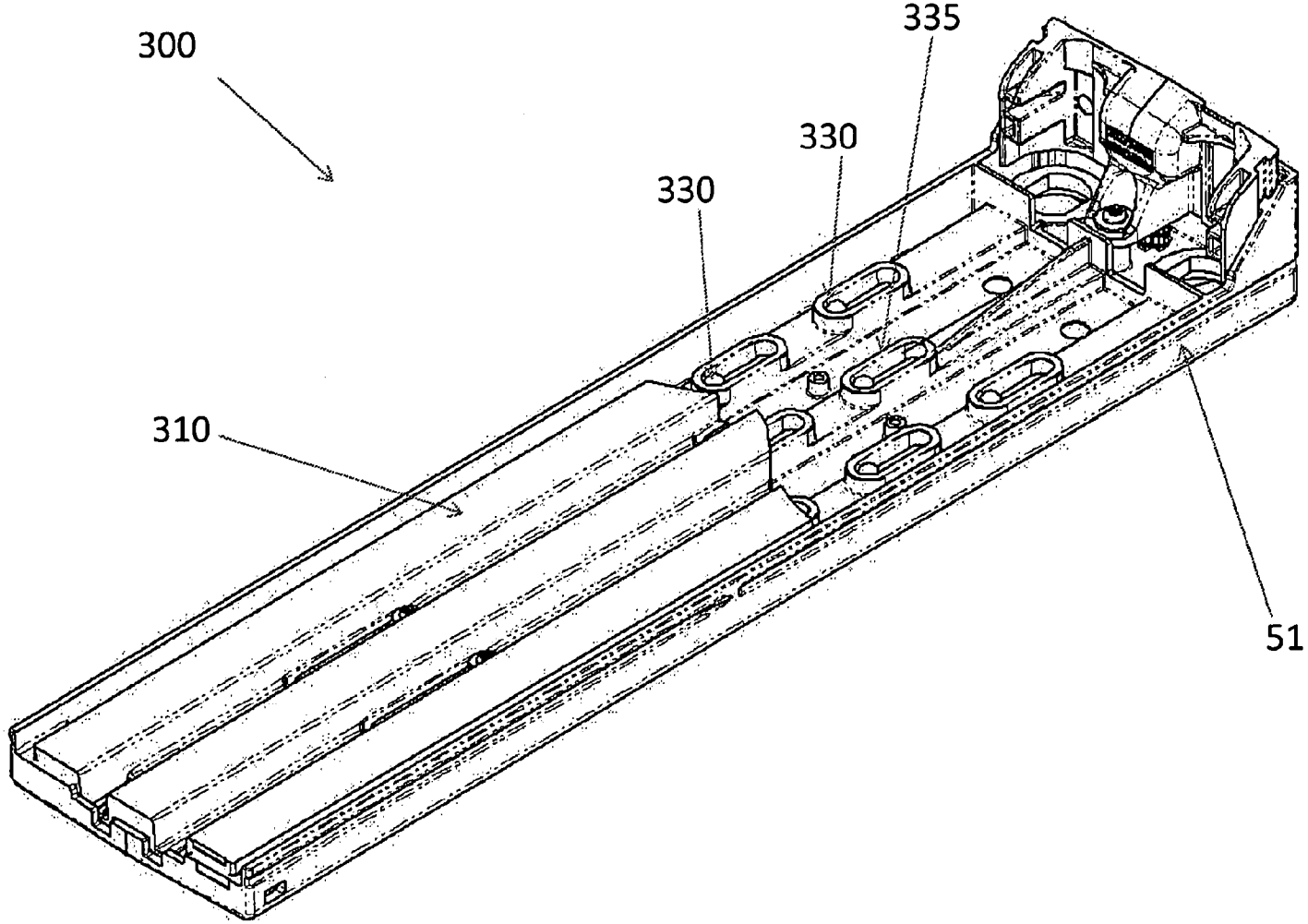
FIG. 10 illustrates various components of an assist mechanism.

In some implementations, document storage apparatus 50 includes an assist mechanism 300 arranged to support the displacement of a stack of documents 60 stacked within document storage assembly 50. Assist mechanism 300 can include a sliding plate 310 slidingly coupled to housing 55 as shown in FIGS. 9 and 10. In some implementations, assist mechanism 300 is slidingly mounted to access cover 51. In some implementations, assist mechanism 300 is slidingly coupled to housing 55 using rolling elements 330 placed in rolling contact between sliding plate 310 and housing 55 (or access cover 51).

FIG. 10 shows an example of assist mechanism 300 slidingly coupled to housing 55 via mounting on access cover 51. Access cover 51 can include longitudinal channels 335 for independently housing rolling elements 330 at multiple locations between sliding plate 310 and access cover 51. Assist mechanism 300 can be arranged to support a stack of documents 60 once the stack size has exceeded a predetermined threshold. In some configurations, when the stack of documents 60 reaches a certain size (i.e., a threshold), the force being exerted by support plate 100 in direction A may be unable to suspend the entire length of the stack above the lower surface of housing 50 due to gravitational effects. When the stack of documents 60 exceeds such a size threshold, at least a portion of the stack will displace downward and rest on the lower surface of housing 50 (or access cover 51 or support plate 310). In some implementations of document storage assembly 50 that include assist mechanism 300, the vertically displaced portion of the stack of documents 60 will abut with sliding plate 310 rather than housing 50.

In some implementations, the stack of documents 60 is arranged to engage assist mechanism 300 upon being inserted into document storage apparatus 50. For example, a newly received document 60 can be positioned relative to opening 52 so as to engage sliding plate 310 during a stacking event. In other implementations, a secondary mechanism (not shown) can interact with the stack of documents 60 so that a pushing plate or other interactive member engages the stack at an opposite location of the stacks abutment with sliding plate 310 so as to ensure all documents in the stack are displaced and abutting sliding plate 310.

The operation of the document storage assembly is now described. When a document 60 is inserted into document handling apparatus 10 through inlet 21, validation module 20 determines the acceptability of document 60. An acceptable document 60 is transported by document handling apparatus 10 to a position adjacent document storage assembly 50. Acceptable documents 60, adjacent to document storage assembly 50, are stacked therein by stacker mechanism 70. As documents 60 are stacked into document storage assembly 50, support plate 100 is displaced by stacking mechanism 70 as shown in FIG. 11. Support plate 100 is urged towards stacking mechanism 70 by biasing mechanism 150. As stacking mechanism 70 extends and pushes a newly received document 60 into document storage assembly 50, support plate 100 is displaced in a direction opposite the urging force exerted by biasing mechanism 150. Displacement of support plate 100 causes gears 120 to rotate along racks 59. As stacking mechanism 70 retracts, biasing mechanism 150 urges support plate 100 towards stacking mechanism 70 (e.g., in direction A).

Figure 12:
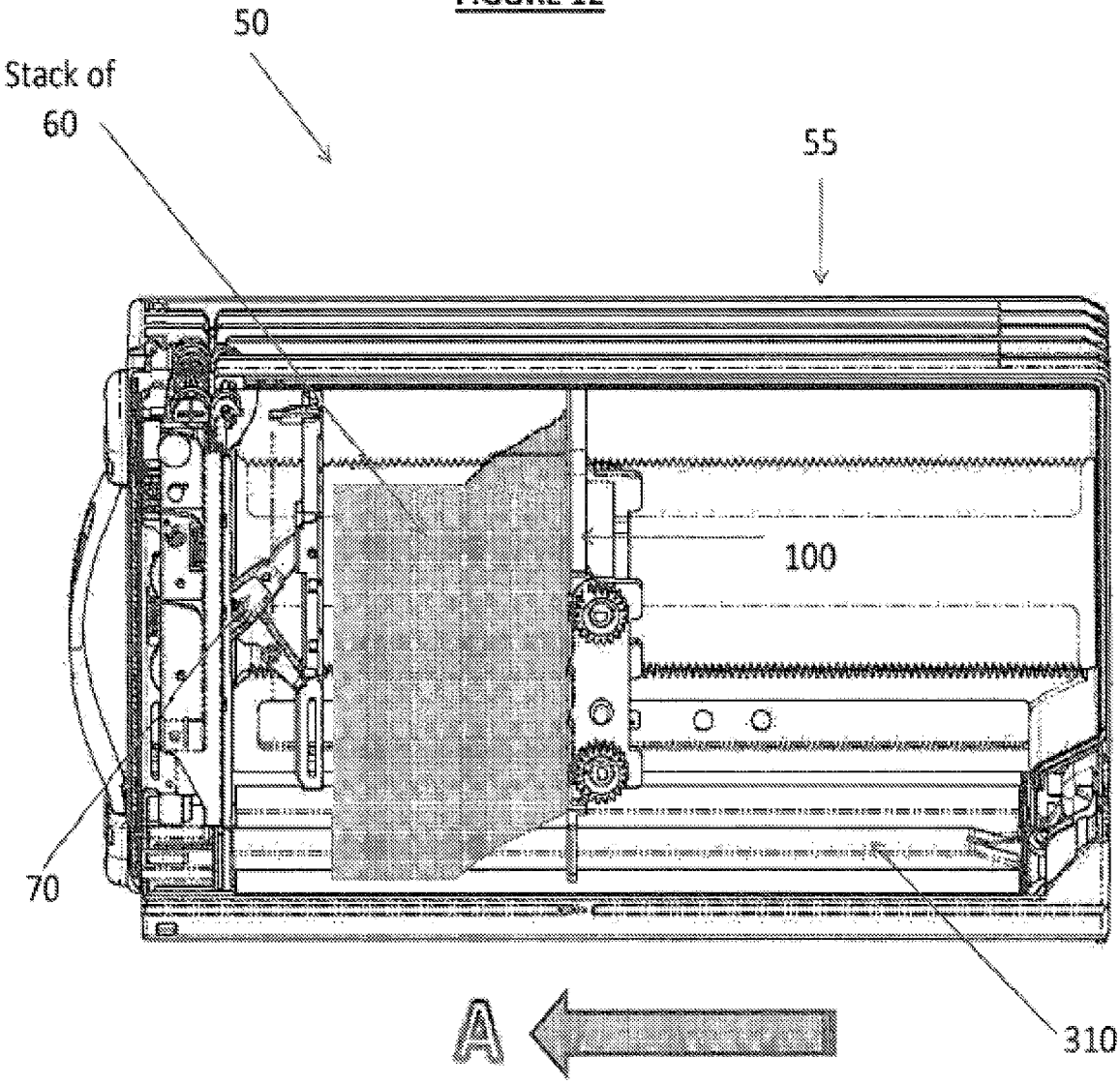
FIG. 12 illustrates a document storage assembly containing a stack of documents having at least a portion of the stack resting on an assist mechanism.

As additional documents are stacked in document storage assembly 50, the size of stacked documents 60 increases. After the stack of documents 60 exceeds a certain threshold, at least a portion of the stack may be displaced downward (e.g., due to gravitational effects) and may abut housing 55 (or sliding plate 310) as shown in FIG. 12. Prior to the stack of documents exceeding a size threshold, support plate 100 maintains the stack of documents 60 in a stable and suspended configuration not in contact with housing 55 (or sliding plate 310). In such a configuration newly stacked documents 60 are added to the stack by displacing support plate 100 without interacting with housing 55 (or sliding plate 310).

Once the stack of documents 60 exceeds a size threshold, a portion of the stack of documents 60 can become vertically displaced so as to abut housing 55 (or sliding plate 310). When the vertically displaced portion of the stack abuts sliding plate 310, the displaced portion of the stack abuts sliding plate 310 (or housing 55) and causes sliding plate 310 to be laterally (or longitudinally) displaced so as to move with the stack of documents 60 as a newly received document 60 is added to the stack. Due to the vertically displaced portion of the stack of documents 60 resting on (or abutting) sliding plate 310, the resistive (or frictional) force required to displace the stack of documents 60 laterally can be maintained (or reduced) so as to be similar to that of a non-vertically displaced stack.

Figure 13:
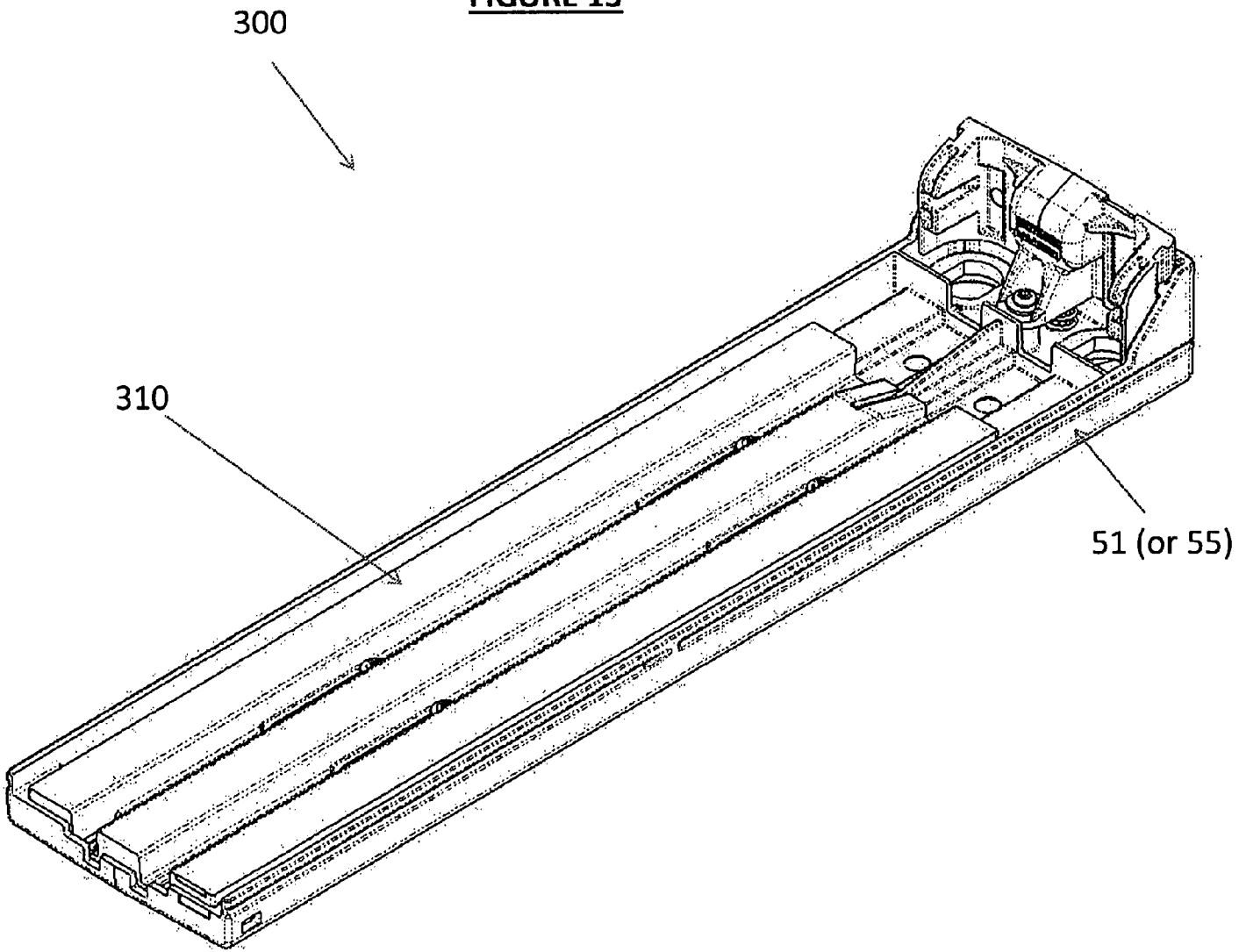
FIG. 13 illustrates an assist mechanism including a sliding plate in an initial position.
Figure 14:
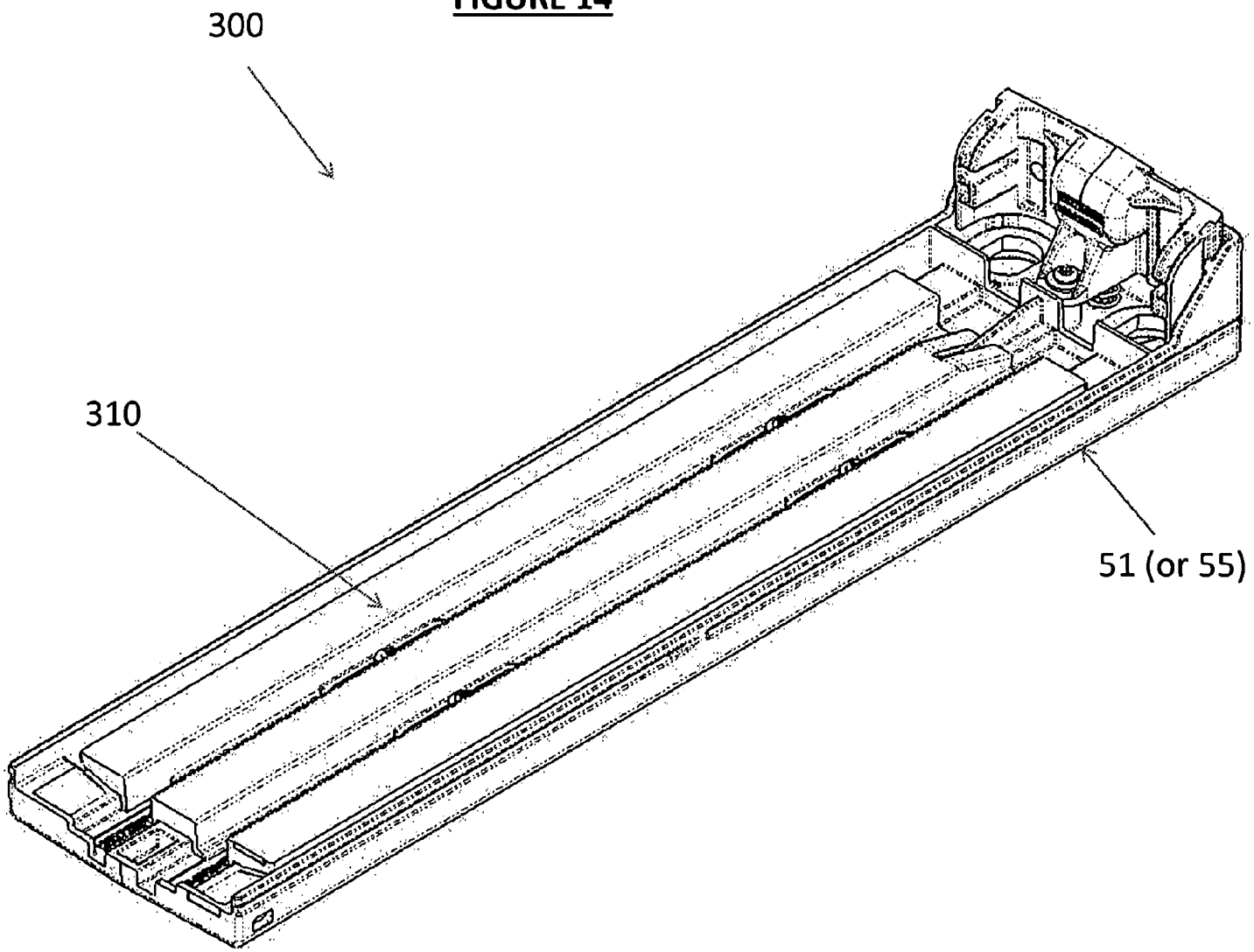
FIG. 14 illustrates an assist mechanism including a sliding plate in an intermediate position.
Figure 15:
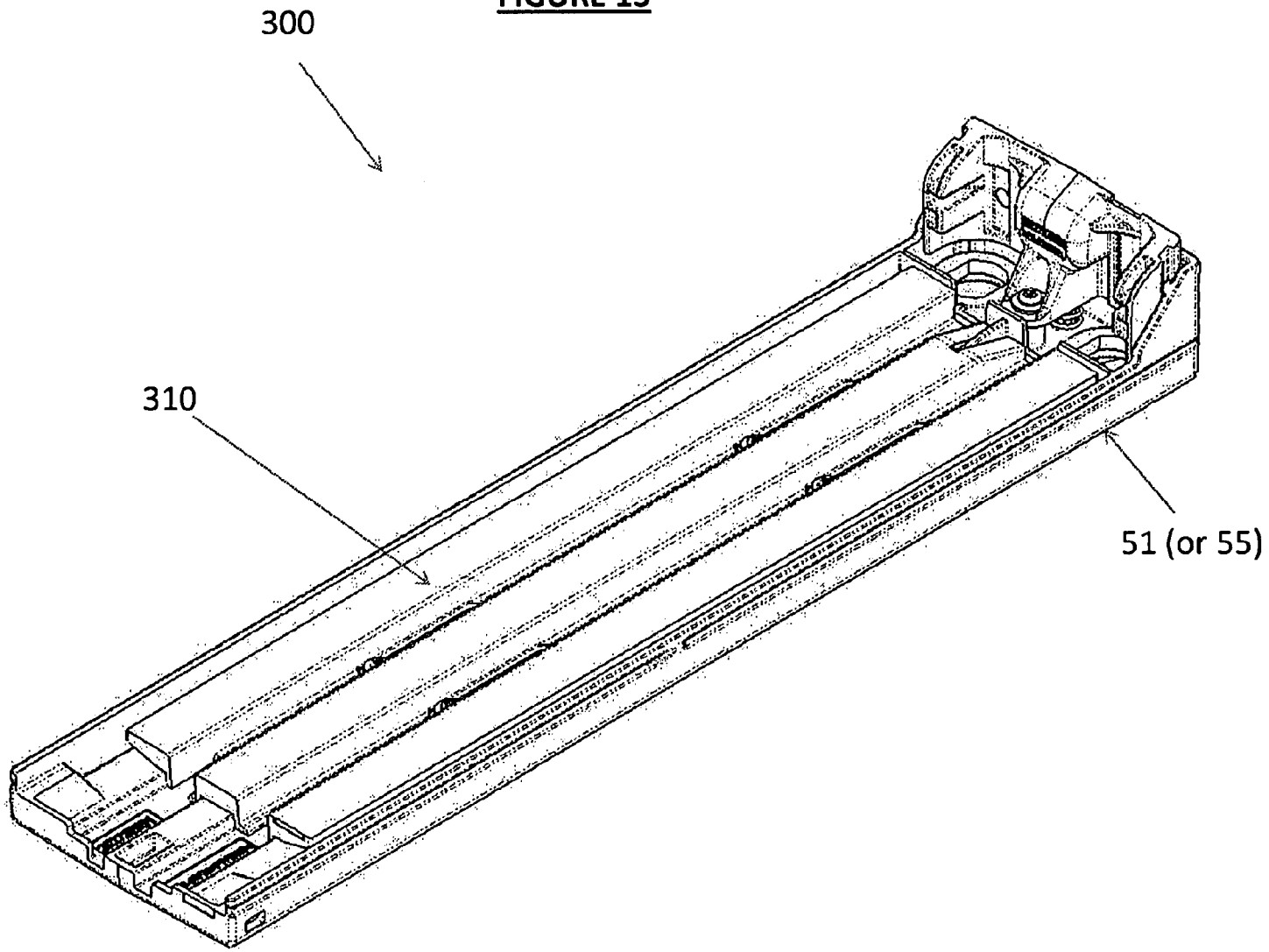
FIG. 15 illustrates an assist mechanism including a sliding plate in an extended position.

For example, FIG. 13 shows sliding plate 310 in an initial position similar to the conditions when the stack of documents 60 size is such that support plate 100 maintains the stack in a suspended or stable configuration so as to not be in abutment (or resting) on sliding plate 310. In the condition where the stack of documents is small enough that no portion is vertically displaced so as to interact with housing 55 (or sliding plate 310), sliding plate 310 is located in a forward most position. As the stack of documents 60 increases, the effects of gravity cause at least a portion of the stack to drop (or displace vertically downward) and abut housing 55 (or sliding plate 310). In some implementations, the size of document storage assembly 50 is configured so as to return sliding plate 310 to an initial position (as shown in FIG. 13) even though at least a portion of the stack rests thereupon. As the stack of documents 60 further increases, each stacking event of a newly received document 60 causes both the stack and sliding plate 310 to be laterally displaced simultaneously. Similarly, as the stack of documents 60 increases, the return position of sliding plate 310, after a stacking event of a newly received document 60, becomes farther away from the initial position. An example of a position of sliding plate 310 in a position away from the initial position is shown in FIG. 14. Continued acceptance of newly received documents into document storage assembly 50 can result in sliding plate 310 being displaced to a fully extended position in which no further documents can be received by document storage assembly 50 as shown in FIG. 15.

In some implementations, document storage assembly 50 includes an installation mechanism 200. Installation mechanism 200 can allow for the removal of support plate 100 from housing 55. Installation mechanism 200 has two states, a locked state and an unlocked state. In the locked state, actuator 208 is in a position displaced laterally inward from the perimeter of support plate 100. Actuator 208 is operatively coupled to linking gear 205 so as to allow linking gear 205 to slide about shaft 210. Laterally inward displacement of actuator 208, and thus linking gear 205, removes linking gear 205 from meshing engagement with gear 120*b* of biasing mechanism 150 and maintaining meshing engagement with a transfer gear 125. Transfer gear 125 can be further meshingly engaged with upper gear 120*a*. As actuator 208 is laterally displaced inward, locking tab 220 also is displaced inward and into a blocking position preventing further rotation of shaft 130 of biasing mechanism 150. More specifically, the blocking position of locking tab 220 causes abutment with protrusion 185 of shaft 130 so as to prevent further rotation of shaft 130 in the direction of arrow Z.

To transition installation mechanism 200 from the locked position to the unlocked position, actuator 208 is moved laterally outward toward the perimeter of support plate 100. Movement of actuator 208 to the unlocked position causes linking gear 205 to slide about shaft 210 and into meshing engagement with gear 120*b*. Additionally, locking tab 220 moves out of a blocking position, thus allowing free rotation (e.g., in direction Z) of shaft 130 of biasing mechanism 150.

Support plate 100 can be removed from housing 55 when installation mechanism 200 is in the locked position. For example, support plate 100 can be located at some distance from the front of housing 55 due to a stack of documents 60. To extract support plate 100, access cover 51 is removed from housing 55 and installation mechanism 200 is placed in the locked position. Having installation mechanism in the locked position causes locking tab 220 to come into abutment with protrusion 185 and thus prevents any further forward movement of support plate 100 (i.e., in direction A). With linking gear 205 not in meshing engagement between transfer gear 125 and lower gear 120*b*, upper gear 120*a* is still free to rotate about shaft 130*a*. By pivoting the upper edge of support plate 100 upper gears 120*a* rotate along rack 59 until they are no longer in contact with rack 59. Once upper gears 120*a* have been removed from contact with rack 59, lower gears 102*b* can be lifted upward away from lower rack 59. Once both pairs of gears 120*a* and 120*b* are no longer in contact with racks 59, support plate can be rotated and extracted from housing 55.

Other implementations are within the scope of the claims.

What is claimed is:

1. A document storage assembly comprising:

a housing for storing a plurality of documents in a stack configuration;

a support plate removably coupled to the housing;

a plurality of gears rotatably connected to the support plate, wherein at least two shafts are arranged to connect at least two pairs of the gears;

a plurality of substantially parallel racks associated with the housing, the racks configured to engage a plurality of the plurality of gears;

a biasing mechanism for biasing the support plate towards one longitudinal end of the housing; and an installation mechanism movable between a locked position and an unlocked position, the locked position of the installation mechanism preventing the biasing mechanism from exerting a biasing force on one of the at least two shafts thus preventing rotation of the shaft, wherein the biasing mechanism includes a spring coupled to one of the at least two shafts.

2. The document storage assembly according to claim 1 wherein the support plate can be removed from the housing when the installation mechanism is in the locked position.

3. A document storage assembly removably coupled to a document validation device having a document stacking mechanism for stacking documents in the document storage assembly comprising:

a housing for storing a plurality of documents in a stack configuration;

a support plate coupled to the housing;

a plurality of gears rotatably connected to the support plate, wherein at least two shafts are arranged to connect at least two pairs of the gears;

a plurality of substantially parallel racks associated with the housing, the racks configured to engage a plurality of the plurality of gears;

a biasing mechanism for biasing the support plate towards one longitudinal end of the housing; and an assist mechanism slidingly coupled to a side of the housing, the assist mechanism including a sliding arrangement allowing the assist mechanism to slide relative to the housing with a low amount of resistance therebetween and arranged such that when the plurality of documents in the stack configuration are contained in the document storage assembly, the assist mechanism abuts a vertically displaced portion of the documents in the stack configuration, the documents in the stack configuration including the vertically displaced portion and a suspended portion not in contact with the assist mechanism.

4. The document storage assembly according to claim 3 wherein the sliding arrangement comprises a series of rollers coupled between the assist mechanism and the housing.

5. The document storage assembly according to claim 3 wherein the sliding arrangement comprises a pair of sliding rails coupled between the assist mechanism and the housing.

6. The document storage assembly according to claim 1 or 3 further comprising an access cover removably coupled to the housing and forming at least a portion of one side of the housing.

7. The document storage assembly according to claim 6 wherein the access cover is arranged to form a lower longitudinal side of the housing below the documents.

8. The document storage assembly according to claim 3, wherein the biasing mechanism includes a spring coupled to one of the at least two shafts.

9. The document storage assembly according to claim 1 or 3, wherein the plurality of gears are rotatably connected to at least two opposite edges of the support plate.

10. The document storage assembly according to claim 1 or 3, wherein the at least two shafts are arranged to connect the at least two pairs of the gears on opposite edges of the support plate.

11. A document storage assembly configured to be removably coupled to a document validation device having a document stacking mechanism for stacking documents in the document storage assembly comprising:

a housing for storing a plurality of documents in a stack configuration;

a support plate coupled to the housing;

a biasing mechanism for biasing the support plate towards the most recently stacked documents at one longitudinal end of the housing;

an access cover removably coupled to the housing and forming at least a portion of one side of the housing; and an assist mechanism coupled to the access cover and comprising a sliding arrangement allowing the assist mechanism to slide relative to the housing with a low amount of resistance therebetween in response to an addition or removal of at least one document from the stack, the assist mechanism abuting a vertically displaced portion of the stack of documents, the documents in the stack configuration including the vertically displaced portion and a suspended portion not in contact with the assist mechanism.

12. The document storage assembly according to claim 11 wherein the sliding arrangement comprises a series of rollers coupled between the assist mechanism and the access cover.

13. The document storage assembly according to claim 11 wherein the sliding arrangement comprises a pair of sliding rails coupled between the assist mechanism and the access cover.

14. The document storage assembly of claim 3, wherein the assist mechanism comprises a sliding plate slidingly coupled to the housing for supporting the plurality of documents in the stack configuration during displacement.

15. The document storage assembly of claim 3, wherein the assist mechanism is arranged to abut the at least a portion of the plurality of documents in the stack once a stack size of the plurality of documents in the stack configuration exceeds a threshold.

16. The document storage assembly of claim 3, wherein the assist mechanism is arranged to support a lateral displacement of the plurality of documents in the stack configuration.

* * * * *